United States Patent [19]

Van Zijll Langhout et al.

[11] 4,259,294

[45] Mar. 31, 1981

[54] APPARATUS FOR THE HYDROGENATION OF HEAVY HYDROCARBON OILS

[75] Inventors: Wouter C. Van Zijll Langhout; Abraham A. Pegels; Joannes B. Wijffels, all of The Hague, Netherlands

[73] Assignee: Shell Oil Company, Houston, Tex.

[21] Appl. No.: 71,333

[22] Filed: Aug. 30, 1979

Related U.S. Application Data

[62] Division of Ser. No. 3,697, Jan. 16, 1979, abandoned.

[30] Foreign Application Priority Data

Jan. 20, 1978 [NL] Netherlands ..... 7800711

[51] Int. Cl.[3] ..... B01J 4/00; B01J 8/04

[52] U.S. Cl. ..... 422/190; 422/219; 422/223

[58] Field of Search ..... 208/152, 176, 210, 251 H, 208/254 H; 422/190, 219, 223, 189, 191, 211

[56] References Cited

U.S. PATENT DOCUMENTS

| | | | |
|---|---|---|---|
| 2,265,837 | 12/1941 | Harding | 208/176 |
| 3,418,234 | 12/1968 | Chervenak et al. | 208/210 X |
| 3,470,090 | 9/1969 | Carson | 208/152 X |
| 3,547,809 | 12/1970 | Ehrlich et al. | 208/176 X |
| 3,772,211 | 11/1973 | Mounce | 208/152 X |
| 3,844,933 | 10/1974 | Wolk et al. | 208/251 H X |
| 3,870,623 | 3/1975 | Johnson et al. | 208/251 H X |
| 4,059,502 | 11/1977 | James | 208/152 |

*Primary Examiner*—Bradley Garris
*Attorney, Agent, or Firm*—Ronald R. Reper

[57] ABSTRACT

A hydroconversion process for heavy hydrocarbon oil and reactor system having a series of closed reactor vessels containing substantially fixed catalyst beds in flow communication with each of one catalyst-supply conduit system and one catalyst-removal conduit system, both of said conduit systems communicating with each reactor in said series of reactor vessels, via separate valve means, whereby each reactor can be separately connected or disconnected to flow communication with each of said conduit systems and whereby process-deactivated catalyst present in each reactor is continuously or periodically replaced by fresh catalyst as a slurry in oil via said conduit systems.

1 Claim, 3 Drawing Figures

APPARATUS FOR THE HYDROGENATION OF HEAVY HYDROCARBON OILS

This is a division of application Ser. No. 3,697, filed Jan. 16, 1979, now abandoned.

BACKGROUND OF THE INVENTION

The invention relates to a process for the catalytic hydrogenation of a heavy hydrocarbon oil at elevated pressure and temperature by passing said hydrocarbon oil through a number of reactors which are arranged in series and contain substantially fixed catalyst beds, in which process the deactivated catalyst present in the reactors is continuously or periodically replaced by fresh catalyst.

For the hydroconversion (particularly demetallization and/or desulphurization) of heavy and particularly residual, hydrocarbon oils in the presence of hydrogen with a catalyst, use can be made of a system of a number of reactors, which contain substantially fixed catalyst beds and can be arranged in series, the stream of hydrocarbon oil being conducted through all the reactors consecutively.

By a substantially fixed catalyst bed is meant a catalyst bed which may contract or expand by less than 10% during the process, depending on whether process is carried out in downflow or upflow of the feed respectively. Said 10% contraction or expansion of the catalyst bed relates to the volume of the catalyst bed during the process in comparison with the volume occupied by the loosely packed catalyst bed in hydrocarbon oil with no oil flowing through the bed.

When use is made of catalysts which are present in reactors as a substantially fixed bed, the catalyst activity may decrease, for example by deposition of coke, tarry products and metals. In a number of cases reactivation, for example by burning off, is possible, but metals deposited on the catalyst cannot be removed in this manner. Moreover, burning off is often objectionable, since the hydrogen-containing gas present in the reactor must be removed therefrom substantially completely before oxygen-containing gas can be admitted. For these reasons it is usually attractive to remove the deactivated catalyst from the reactor and replace it by active catalyst. A number of processes are known and are described e.g., in U.S. Pat. Nos. 2,963,525, 3,547,809 and 4,017,382.

In order to enable the stream of hydrocarbon oil to be optionally passed or not passed through each reactor and the catalyst to be supplied to or removed from each reactor, each reactor is provided with means for the supply and removal of feed and catalyst, which are so designed that each reactor can be separately connected to and disconnected from the supply and removal lines of both feed and catalyst.

During operation the catalyst in a reactor can be replaced by continuously or periodically removing a quantity of deactivated catalyst from this reactor and (in general simultaneously or subsequently ) supplying about the same quantity of fresh catalyst to said reactor.

When the catalyst in a reactor has become deactivated to such an extent that its complete removal is required, it is also possible to disconnect this reactor from the supply and removal lines of the hydrocarbon mixture, remove the catalyst from the reactor and replace it by fresh catalyst.

The catalyst can be removed by dumping it by gravity into a high-pressure lock, i.e., enclosure, which has been brought to the same hydrogen pressure as the reactor.

After isolation of the reactor the lock can be brought to atmospheric pressure and the deactivated catalyst can be dumped into a storage tank which is situated at a lower level. The fresh catalyst can be supplied to the reactor from a high-pressure lock by dumping it by gravity. In order to prevent clogging the valves in the said provisions for catalyst supply and removal must have a large diameter, which makes them complicated and expensive to construct.

In order to ensure a good sealing when the valve is closed, solid catalyst remnants must be removed before closure. The catalyst remnants can be removed by passing an oil stream along the valve at high speed. In the case of large valves this requires a very large oil throughput, since the quantity of oil which must be passed through in order to obtain a given flow rate is proportional to the square of the valve diameter.

Moreover, arrangements in which the catalyst is supplied to or is removed from the reactor by gravity, in the case of the present very large reactors result in very tall and often unacceptably high plants, since both above and below the reactor a lock and a catalyst storage tank must be present.

It is also felt as a drawback that a large number of high-pressure locks is necessary, since each reactor must be provided with two high-pressure locks and storage tanks, including the above-mentioned appurtenant expensive and complicated large-diameter valves.

The invention provides a process in which the necessary number of high-pressure locks is much lower, the valves to be used therein may have a smaller diameter and the number of tanks into which the deactivated catalyst is passed and from which the fresh catalyst is supplied, is also much lower and these tanks, like the high-pressure locks, need not be situated below and above the reactors respectively.

SUMMARY OF THE INVENTION

The invention therefore relates to a process for the catalytic hydrogenation of a heavy hydrocarbon oil at elevated pressure and temperature, by passing said hydrocarbon oil through a number of reactors which are arranged in series and contain substantially fixed catalyst beds, in which process the deactivated catalyst present in the reactors is continuously or periodically replaced by fresh catalyst, characterized in that the deactivated catalyst is removed and fresh catalyst is supplied as a slurry in oil, by means of one conduit system for catalyst removal and one conduit system for catalyst supply, to which conduit systems each reactor can be separately connected and disconnected and which conduit systems are at substantially the same pressure as the reactors.

The invention therefore provides a process for catalytic hydroconversion of a heavy hydrocarbon oil feed which comprises passing said feed together with hydrogen through a reaction zone at elevated temperature and pressure, said reaction zone comprising a plurality of closed reactors arrayed in series and containing substantially fixed beds of hydroconversion catalyst, removing deactivated catalyst from at least one of said reactors as a slurry in oil, continuously or periodically, into one catalyst-removal conduit system at substantially the same pressure as said reactor and disposed to communicate with each reactor in said zone via separate valve means;

supplying fresh catalyst to each said reactor from which deactivated catalyst has been removed from one catalyst-supplying conduit system at substantially the same pressure as said reactor, continuously or periodically, said catalyst-supply conduit system being disposed to communicate with each reactor in said zone via separate valve means, and communicating with a source of fresh catalyst as a slurry in oil, and withdrawing hydroconverted hydrocarbon product and hydrogen from said reaction zone.

The invention further provides an apparatus for catalytic treatment of hydrocarbons comprising:

plurality of closed reactors suitable for containing a substantially fixed bed of particulate catalyst, each said reactor having two inlets, a reactor inlet for admitting reactants to an upstream side of said catalyst bed and a catalyst inlet for admitting fresh catalyst; each said reactor having two outlets, a reaction effluent outlet for passing reaction effluent from each said reactor, and a catalyst outlet for passing deactivated catalyst from each said reactor;

a reactant source conduit means communicating with a source of reactants and with the inlet of each said reactor, a reaction effluent conduit means communicating with the outlet of each said reactor, for withdrawing reaction effluent therefrom, and ultimate withdrawing of reaction effluent from the apparatus;

a plurality of reactant flow valve means disposed on each of said reactant source conduit means and said reaction effluent conduit means for isolating any of said reactors from flow of reactants through the remaining reactors serially;

one catalyst supply conduit, communicating with a source of particulate catalyst as a slurry and with the catalyst inlet of each reactor for supplying fresh catalyst to each said reactor, and communication with a source of pressure for pressuring said catalyst support conduit to substantially reactor pressure;

one catalyst removal conduit, communicating with the catalyst outlet of each said reactor for removal of deactivated catalyst from said apparatus, and communicating with a source of pressure for pressuring said catalyst removal conduit to substantially reactor pressure, and a plurality of catalyst flow valve means disposed on each of said catalyst supply conduit and said catalyst removal conduit for isolating any of said reactors for removing deactivated catalyst therefrom and supplying fresh catalyst thereto.

DESCRIPTION OF PREFERRED EMBODIMENTS

Figure 1:
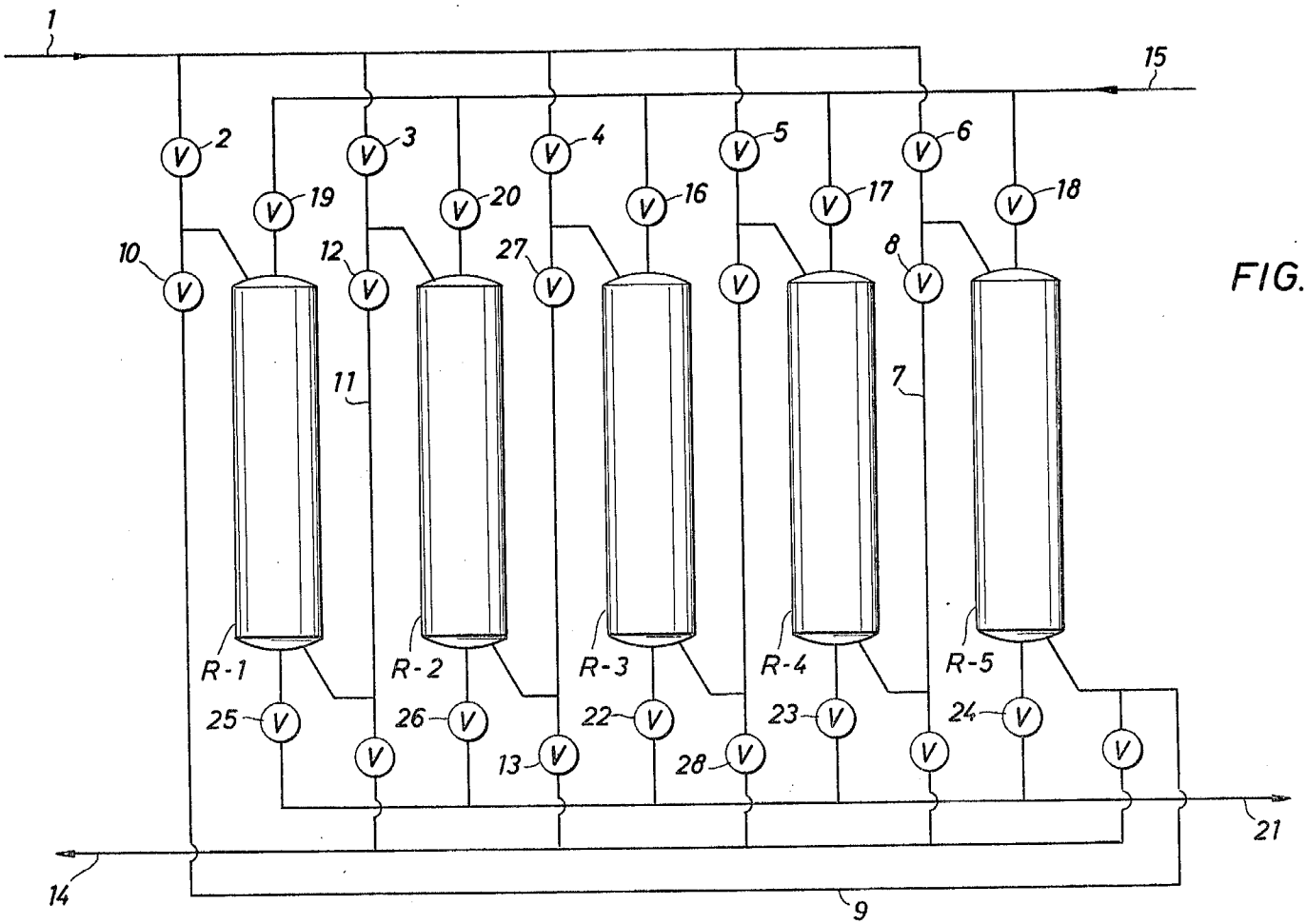
FIG. 1 is a diagrammatic representation of a series of reactors in which a heavy hydrocarbon oil is catalytically hydrogenated together with one catalyst-supply conduit system and one catalyst-removal conduit system communicating with each of the closed vessel reactors via valve means according to the concepts of the present invention.

The conduit systems for the supply and removal of catalyst to and from the reactors are generally so designed that the catalyst can be pumped through the system as an oil slurry.

According to the process of the invention, catalyst is very suitably passed from a reactor to the conduit system for catalyst removal by means of a rotary valve.

Since the conduit system is at substantially the same pressure as the reactor, the catalyst can be passed from the reactor to said conduit system in small portions and at the desired rate. In order to obtain homogeneous slurry stream in the conduit system, exit chambers are very suitably present in the conduit system for catalyst removal in which the said rotary valves debouch.

The process according to the invention is preferably so carried out that the catalyst is passed through the conduit system for catalyst removal to a catalyst lock which can be brought to atmospheric pressure. After this lock has been filled with deactivated catalyst at high pressure the catalyst can be removed from the said lock after pressure release, if desired after separation of part of the oil from the catalyst at the said high pressure. The high-pressure valves required therefor are filled with slurry, so that the risk of clogging of the valves is not great and the latter may have a much smaller diameter than when catalyst as such must be passed through them. The use of small-diameter valves in high-pressure valves service has the additional advantage that any gas leaks are of smaller size than in the case of larger-diameter valves.

The catalyst may be passed from the lock to a storage tank.

The oil used in the conduit system for catalyst removal is preferably a readily pumpable, not highly viscous oil, for example a gas oil. Its temperature may be considerably lower than that of the catalyst to be removed and any accompanying heavy hydrocarbon oil, which results in a slurry of a lower temperature than the reactor temperature.

If a reactor is completely disconnected from the supply and removal of hydrocarbon oil, in order to remove deactivated catalyst from the reactor, the latter is very suitably kept under reaction conditions, as far as pressure is concerned, during catalyst removal. After complete or partial removal of the heavy hydrocarbon oil a light purge oil (for example a gas oil) is optionally supplied to the reactor, preferably countercurrently, in order to eliminate possible clogging, whereupon the catalyst can be removed from the reactor.

In order to facilitate catalyst removal, each reactor is very suitably of the type described in the U.S. Pat. No. 3,966,420 and contains at least one tray as well as supporting means for one or more catalyst beds, which supporting means are permeable to liquid and gas and impermeable to catalyst particles and have at least partly the shape of a conical surface of a truncated cone, which supporting means are supporting means are permeable to liquid and gas and impermeable to catalyst particles and have at least partly the shape of a conical surface of a truncated cone, which supporting means are secured to the reactor wall and having a downwardly directed opening permeable to catalyst particles, a tray being located under each support means which tray is permeable to liquid and gas and impermeable to catalyst particles, which tray has an opening which is permeable to catalyst particles.

To the conduit system for the supply of catalyst to the reactors a catalyst lock is preferably connected which can be brought to elevated pressure. It is possible to fill this lock with catalyst from a storage tank at atmospheric pressure and subsequently to bring the lock to the same pressure as the conduit system for catalyst supply.

A rotary valve is very suitably present between the said lock and the conduit system for catalyst supply. It is of advantage that in the conduit system for catalyst supply an exit chamber is present in which the said rotary valve debouches; consequently, a homogeneous stream of slurry can be obtained in the conduit system.

The oil used in the conduit system for the supply of fresh catalyst, in which the catalyst is incorporated as a slurry, is very suitably the heavy hydrocarbon oil to be hydrogenated which has previously been brought to about the temperature at which the hydroconversion is carried out. It is preferred to use as oil in the conduit system for fresh catalyst supply to a lighter oil than the heavy hydrocarbon oil to be treated, for example a gas oil, and to separate this lighter oil from the catalyst before the latter is introduced into the reactor. This can very conveniently be effected by means of a sieve attached to the upper end of the reactor. The separated lighter oil can be recycled and again be used for the formation of a slurry of the fresh catalyst.

Since the said lock and conduit system in the supply system for active catalyst are kept at a pressure which is about the pressure prevailing in the reactors through which the stream of residual hydrocarbon oil to be hydrogenated is passed, it is of great advantage that provisions to bring the pressure from atmospheric pressure to that of the conduit system are to be made only at the location of said lock, which is filled with fresh catalyst at atmospheric pressure. If a separate device for the supply of catalyst were to be provided at the location of each reactor, this would not only result in a much larger number of high-pressure locks being necessary, but moreover the high-pressure locks and the hoppers or other storage tanks of catalyst would have lead to unattractively high plants. Since the fresh (i.e. active) catalyst is pumped as a slurry through the conduit system, the lock from which the catalyst is supplied to the conduit system can be located at any desired height and place, just like the storage tank from which the high-pressure lock is filled.

The process according to the invention is particularly suitable for performing catalytic hydroconversions in which the catalyst loses its activity in a relatively short time owing to the formation of deposits on the catalyst surface, and in which the catalyst cannot be regenerated in the reactor in a simple manner, such as desulphurization and/or demetallization of a crude oil or a reduced crude oil containing an asphaltene fraction e.g. a residual hydrocarbon oil containing at least 10 ppmw of metal. In the case of heavy petroleum having less than about 30% volume boiling below e.g. 325° C., the said metal in many cases consists of nickel and vanadium, which are liberated from the compounds in which they are bound, during the hydroconversion and are deposited as metals on the catalyst.

The catalyst used for the said hydroconversion of a residual hydrocarbon oil is very suitably a sulphur-resistant catalyst containing one or more metals of Group VB, VIB, VIIB and/or VIII of the periodic table of the elements, their sulphides and/or oxides, deposited on an amorphous refractory inorganic oxide of elements of Group II, II or IV of the periodic table of the elements, or on compositions of the said inorganic oxides.

As very suitable metals may be mentioned in Group VB vanadium, in Group VIB molybdenum and tungsten, in Group VIIB manganese and in Group VIII cobalt and nickel. Preference is given to metal combinations, such as nickel-tungsten, nickel-molybdenum, cobalt-molybdenum and in particular nickel-vanadium, especially when as a result of the process according to the invention metals must be removed from the hydrocarbon mixtures.

The amorphous refractory inorganic oxide on which the metals of Group VB, VIB, VIIB or VIII, their sulphides and/or oxides, (are supported) is very suitably alumina or silica-alumina and is particular silica. Zeolitic carriers can also be used.

For the demetallization of residual hydrocarbon oils having a total nickel and vanadium content in excess of 500 ppmw it is also possible to use instead of the above-mentioned catalyst an amorphous fire-resistant inorganic oxide which is not loaded with one or more metals of Group VB, VIB, VIIB and/or VIII or their compounds, for example silica, alumina or silica-alumina, for example as described in the Netherlands patent application 7,607,552.

The particle size of the catalyst is in general less than 5 mm and is preferably between 0.5 and 3 mm. The catalyst may have any shape, such as pellets, cylinders, tablets, lobed extrudates and in particular granules.

The reaction conditions may vary within wide limits, and will be adapted to the desired type and degree of conversion.

It is in general very convenient that the temperature in the reactors is in the range from 300° to 475° C., preferably from 350° to 445° C., the total pressure from 30 to 350 bar, preferably from 40 to 160 bar, the space velocity from 0.1 to 10, preferably from 0.5 to 5 parts by weight of hydrocarbon oil per volume part of catalyst per hour, and the hydrogen/hydrocarbon oil ratio is 150–2,000, preferably 250–1,000 Nl of hydrogen per kg of hydrocarbon oil.

The hydrogen required for the hydroconversion may be a hydrogen-containing gas stream such as a reforming gas stream or a substantially pure hydrogen. The hydrogen-containing gases comprise preferably at least 60% by volume of hydrogen.

The process according to the invention is very suitably carried out mainly in the liquid phase. This means that during the process at least 80% by volume of the hydrocarbon oil to be converted is present in the liquid phase. If desired, the process according to the invention may also be carried out completely in the liquid phase. In this case the full quantity of hydrocarbon oil to be converted is present in the liquid phase during the process and no more hydrogen is used for the hydroconversion than can be dissolved in the liquid hydrocarbon phase under the prevailing reaction conditions, so that the formation of a gas phase is prevented.

The reactors through which the hydrocarbon oil to be hydroconverted is passed are filled with catalyst, and since the sequence of the reactors through which the hydrocarbon oil must flow can be chosen, the hydrocarbon oil can optionally first be contacted with the most active catalyst or with the catalyst which is deactivated to the highest degree, or otherwise.

The invention also relates to an apparatus suitable for the catalytic hydrogenation of heavy hydrocarbon oils at elevated temperature and pressure, consisting of a number of reactors which can contain a fixed catalyst bed, which can be arranged in series in respect of the passage of the hydrocarbon oil to be converted, which apparatus is characterized in that the reactors are provided with means for the supply and removal of feed and catalyst, which means are so designed that each reactor can be separately connected to and disconnected from the supply and removal of both feed and catalyst, and that one conduit system for catalyst supply is present from which each reactor can be supplied with catalyst, and one conduit system is present in which the removal of catalyst from each reactor can take place, and that the said conduit systems can be brought to substantially the same pressure as the reactors during operation.

The invention will be illustrated with reference to FIGS. I, II, and III, which in fact represent only one of the many embodiments of the invention.

Figure 3:
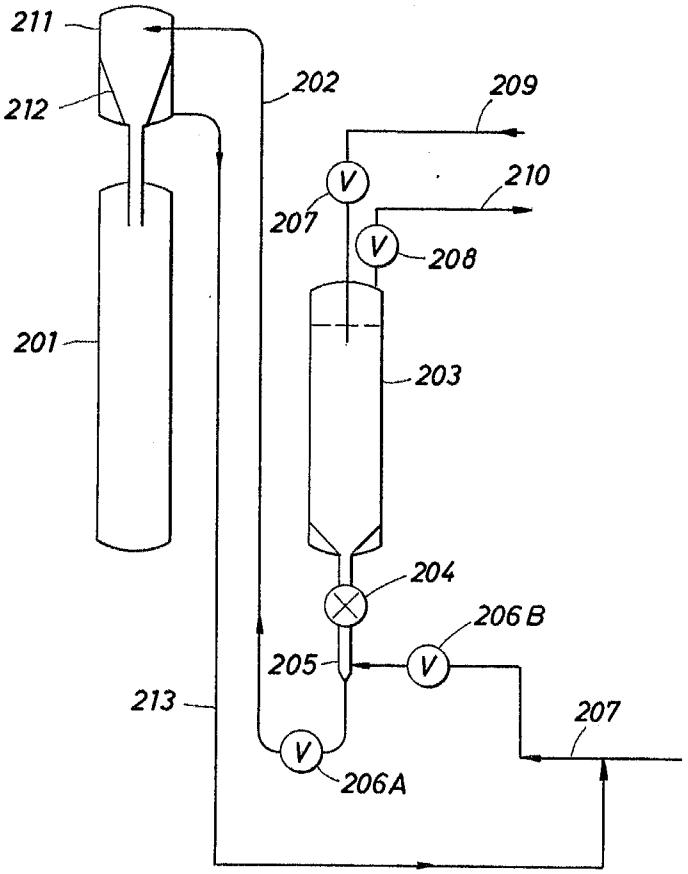
FIG. 3 diagrammatically represents part of the supply system for catalyst and its' connections to one reactor.
Figure 2:
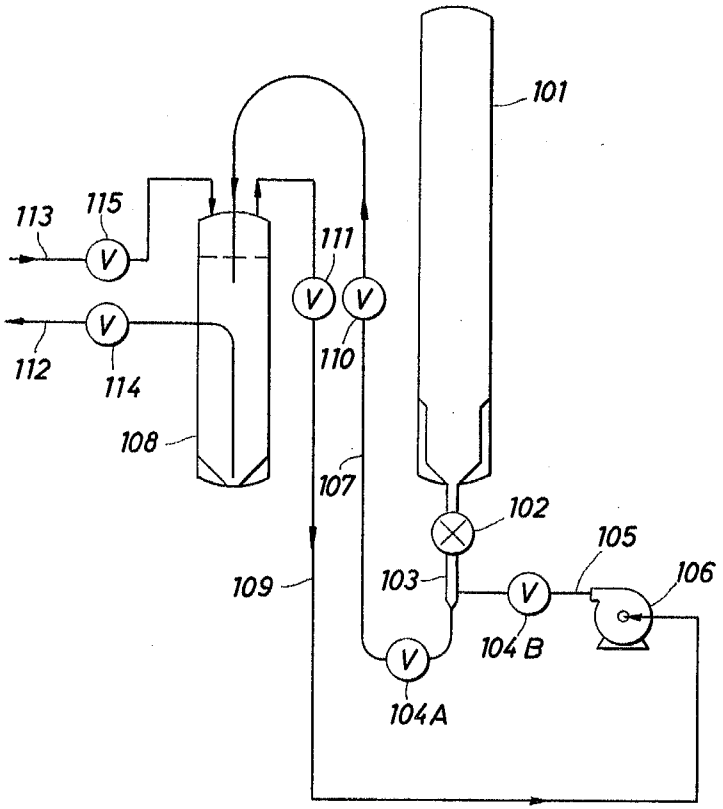
FIG. 2 is a diagrammatic representation of part of the removal system for catalyst and its' connection to one reactor.

FIG. 1 is a diagrammatic representation of a series of reactors in which a heavy hydrocarbon oil is catalytically hydrogenated, FIG. 2 shows part of the removal system for catalyst and its connection to one reactor, FIG. 3 shows part of the supply system for catalyst.

The figures are diagrammatic; for a better illustration of the invention, valves, pumps, etc. are ommitted in so far as they were not necessary.

FIG. 1 shows five reactors R-1 to R-5. The hydrocarbon oil to be treated is supplied through line 1 and introduced into a selected reactor by means of one of the valves 2, 3, 4, 5 or 6. In FIG. 1 only valve 5 is open and the feed enters reactor R-4. The stream of hydrocarbon oil leaving reactor R-4 is passed to reactor R-5 through line 7 and open valve 8. From R-5 the treated hydrocarbon oil is removed and passed to reactor R-1 through line 9 and open valve 10, and from the latter reactor to reactor R-2. The hydrotreated hydrocarbon oil is finally removed through valve 13 and line 14.

The reactors can also be separately connected to a conduit system through which the catalyst can be supplied through line 15, which line can be separately connected to each reactor by means of valves 16, 17, 18, 19 and 20. In FIG. 1 only valve 16 is open, so that the catalyst can be supplied to reactor R-3, through which no hydrocarbon oil flows.

Finally, the reactors can be separately connected to a conduit system 21, through which the catalyst can be removed from the reactors. The reactors are in communication with said conduit system through valves 22, 23, 24, 25 and 26; in the situation of FIG. 1 only valve 22 is open, so that catalyst can be removed from reactor R-3 through which no hydrocarbon oil flows. It will be obvious that valves 16 and 22 need not be open simultaneously, as shown in FIG. 1. It is for example, also possible first to remove deactivated catalyst from R-3 with the valve 22 in open position and the valve 16 in closed position, and subsequently to supply active catalyst to R-3 with the valve 22 in closed position.

After R-3 has been filled with fresh catalyst, hydrocarbon oil can again flow through this reactor and, for example, reactor R-4 can be shut down by closing the valves 16 and 22, opening the valves 27 and 28 and subsequently closing valve 13, opening valve 6 and closing valves 5 and 8, whereupon the catalyst in R-4 can be replenished by opening valves 17 and 23 consecutively or simultaneously.

In FIG. 2, 101 represents a reactor to be emptied, from which the catalyst can be passed to exit chamber 103 by means of a rotary valve 102. When valves 104A and 104B are open, oil can be pumped through exit chamber 103 via line 105 by means of pump 106, which oil leaves the exit chamber 103 through line 107 as a catalyst slurry in oil. This slurry is introduced into lock 108. The catalyst settles and, if desired, supernatant oil can be recycled through line 109. The lock 108 can be disconnected from the conduit system, which is at high pressure, by means of valves 110 and 111 and can subsequently be brought to atmospheric pressure. The catalyst can be removed from the lock through line 112. Oil can be supplied through line 113. Lines 112 and 113 are provided with high-pressure valves 114 and 115 which are closed during the removal of catalyst from reactors.

To the conduit system described hereinbefore each reactor is connected in the described manner; the catalyst from each reactor can be passed to lock 108.

If FIG. 3, 201 represents a reactor which can be filled with a catalyst slurry through line 202. The active catalyst can be transported from lock 203 to exit chamber 205 through rotary valve 204. When the valves 206A and 206B are open an oil stream can be pumped through line 207, which stream entrains the catalyst and transports it as a slurry through line 202 to a tank 211 located above the reator.

Said tank contains sieve 212 which separates most of the oil from the catalyst. The separated oil is returned to line 207 through line 213. The catalyst separated in tank 211 descends into reactor 201.

During the filling of the reactors, the lock 203 is at high pressure. It can be brought to atmospheric pressure by closing the high-pressure valves 206A and 206B and opening the high-pressure valves 207 and 208 which are located in the supply line for catalyst slurry 209 and removal line for excess oil 210.

Each reactor can be separately connected to the supply line 202 and supplied with catalyst.

What we claim is:

1. An apparatus for catalytic treatment of hydrocarbons comprising:

a plurality of closed reactors in series arrangement suitable for containing a substantially fixed bed of particulate catalyst, each said reactor having two inlets comprising a reactor inlet for admitting reactants to an upstream side of said catalyst bed and a catalyst inlet for admitting fresh catalyst; each said reactor having two outlets comprising a reaction effluent outlet for passing reaction effluent from each said reactor and a catalyst outlet for passing deactivated catalyst from each said reactor;

a reactant source conduit means communicating with a source of reactants and with the inlet of each said reactor, a reaction effluent conduit means communicating with the outlet of each said reactor, for withdrawing reaction effluent therefrom, and ultimate withdrawing of reaction effluent from the apparatus;

a plurality of reactant flow valve means disposed on each of said reactant source conduit means and said reaction effluent conduit means for isolating any of said reactors from flow of reactants through the remaining reactors serially;

one catalyst supply conduit, communicating with a source of particulate catalyst as a slurry and with the catalyst inlet of each reactor for supplying fresh catalyst to each said reactor, and communication with a source of pressure for pressuring said catalyst supply conduit to substantially reactor pressure;

one catalyst removal conduit, communicating with the catalyst outlet of each said reactor for removal of deactivated catalyst from said apparatus, and communicating with a source of pressure for pressuring said catalyst removal conduit to substantially reactor pressure, and a plurality of catalyst flow valve means disposed on each of said catalyst supply conduit and said catalyst removal conduit for isolating any of said reactors for removing deactivated catalyst therefrom and supplying fresh catalyst thereto.

* * * * *